United States Patent [19]

Bolender

[11] 4,363,615

[45] Dec. 14, 1982

[54] DRIVABLE ROLL OF CONTROLLABLE FLEXURE, PARTICULARLY FOR MACHINES FOR THE PRODUCTION AND PROCESSING OF WEBS OF PAPER OR PLASTIC

[75] Inventor: Walter Bolender, Erkrath, Fed. Rep. of Germany

[73] Assignee: ER-WE-PA Maschinenfabrik u. Eisengiesserei GmbH, Erkrath, Fed. Rep. of Germany

[21] Appl. No.: 307,253

[22] Filed: Sep. 30, 1981

[30] Foreign Application Priority Data

Oct. 13, 1980 [DE] Fed. Rep. of Germany ..... 3038587

[51] Int. Cl.[3] ..... B30B 3/00

[52] U.S. Cl. ..... 425/363; 425/373

[58] Field of Search ..... 425/363, 367, 368, 373, 425/374

[56] References Cited

U.S. PATENT DOCUMENTS 4,233,011 11/1980 Bolender et al. ..... 425/363 X

FOREIGN PATENT DOCUMENTS 2050696 4/1971 Fed. Rep. of Germany .

*Primary Examiner*—J. Howard Flint, Jr.

*Attorney, Agent, or Firm*—Sprung, Horn, Kramer & Woods

[57] ABSTRACT

A drivable roll of controllable flexure, particularly for machines for the production and processing of paper or plastic webs. The roll comprises a cylindrical inner part (1) which through journals is firmly supported on bearing surfaces (5), and a tubular outer part (3) which is rotatably supported on the inner part (1). On the inner part (1) there are disposed along a generatrix means for the generation of compulsive forces acting radially between the inner part and the outer part. A drive shaft (6) which extends coaxially through the journal (2) and which is supported on the journal and on the inner part is integral with a center gear (10) which through an idler gear (11) drives an internal ring gear (14) that is secured to the outer part (3) through clamping means (15*a*, 15*b*). The axis of rotation (Z) of the idler gear (11) is parallel to the drive shaft (6), and its teeth (11*a*) have a crest which arcuately slopes downwardly on either side in the direction of the axis of rotation (Z). The drive can be implemented readily and at low cost. The roll will withstand high loads even with small-diameter journals, and deflections of the outer part will not interfere with the operation of the drive.

4 Claims, 2 Drawing Figures

DRIVABLE ROLL OF CONTROLLABLE FLEXURE, PARTICULARLY FOR MACHINES FOR THE PRODUCTION AND PROCESSING OF WEBS OF PAPER OR PLASTIC

BACKGROUND OF THE INVENTION

1. Field of the Invention

The invention relates to a drivable roll of controllable flexure, particularly for machines for the production and processing of paper or plastic webs.

2. Discussion of the Prior Art

Rolls of controllable flexure are basically known. U.S. Pat. No. 4,233,011, for example, the disclosure of which is hereby incorporated herein by reference, discloses a roll of this type comprising a substantially cylindrical inner part which through journals is firmly supported on a bearing surface, and a tubular outer part which surrounds the inner part and is supported at both ends on the inner part for rotation about the cylinder axis, there being disposed on the inner part along a generatrix means for generating compulsive forces acting radically between the inner part and the outer part. See FIG. 2 of U.S. Pat. No. 4,233,011.

In this non-driven prior-art roll of controllable flexure, unilateral heating of the inner part is utilized to secure a flexure of said part that is transmitted to the outer part since the latter is supported on the inner part. This makes it possible not only to compensate the natural deflection of the roll in order to achieve uniform contact pressure but also to secure in addition, for certain purposes, arching of the roll over given regions. It has now been found that practical problems will arise when a roll of controllable flexure is to be constructed as a drivable roll.

Drivable rolls of controllable flexure are also known per se.

For example, German Auslegschrift DAS No. 20 50 696, the disclosure of which is hereby incorporated herein by reference, describes a roll intended for high flexural loads in which a drive shaft which extends coaxially through one of the journals and in proximity to its outer end is supported on the journal is connected to a center gear which through a gear train mounted on the inner part drives an internal ring gear that is coaxial with the outer part and is in a driving relation therewith. In this prior-art roll, the gear train comprises two idler gears which are diametrically disposed in relation to the center gear and project through slots in the journal to mesh with the internal ring gear which is externally set onto and mounted on the end face of the outer part of the roll. To obtain troublefree operation of the drive even with pronounced deflection of the outer part of the roll, the center-gear shaft is not supported on the inner part of the roll but is connected to the drive shaft only through a flexible coupling. To provide for trouble-free operation of the drive, specified conditions must be satisfied with respect to the spacing of the center of the center gear from both the swivel point of the flexible coupling and the center of the self-aligning bearing between the outer and inner parts of the roll.

This prior-art roll has the drawback that it is of a rather complex design and expensive to produce,; and the two slots in the inner part through which the two idler gears project weaken that part considerably, thus limiting the maximum load it will sustain, unless it is overdimensioned. Moreover, since the center gear is connected to the drive shaft through a flexible coupling, the speed of rotation which can be transmitted, and hence the transmission ratio of the gear train, is limited. The center gear must be of relatively large size, which means high production costs and also requires a corresponding dimensioning of the journal. The high cost of this design is compounded by the fact that since the gear ratio is limited, relatively high torques must be transmitted to the gear train through drive shaft and flexible coupling. Moreover, making and maintaining the mentioned adjustment is complicated, and because of the disposition of the center gear and the manner in which it is connected, operation will be noisy, especially at higher rotative speeds. Finally, the torque must be transmitted from the internal ring gear mounted on the end face of the outer part to the outer part through interlocking connecting members, for example, bolted joints, which again poses adjusting and dimensioning problems.

SUMMARY OF THE INVENTION

The point of departure of the invention is a drivable roll of controllable flexure, particularly for machines for the production and processing of paper or plastic webs, which comprises a substantially cylindrical inner part which through journals is firmly supported on a bearing surface, and a tubular outer part which surrounds the inner part and is supported at both ends on the inner part for rotation about the cylinder axis, there being disposed on the inner part along a generatrix means for generating compulsive forces acting radially between the inner part and the outer part, a drive shaft which extends coaxially through one of the journals and in proximity to its outer end is supported on the journal being connected to a center gear which through a gear train mounted on the inner part drives an internal ring gear that is coaxial with the outer part and is in a driving relation therewith.

The object of the invention is to improve a drivable roll of controllable flexure of this type in such a way that through simple, low-cost means a drivable roll is obtained which makes it possible to develop high line-contact pressures, and hence high loading, even with small-diameter rolls, and in particular with small-diameter journals, in which deflections of the outer part will not interfere with the drive, and which does not require special measures for making and maintaining a given adjustment.

In accordance with the invention, this object is accomplished in that the drive shaft is supported at its inner end on the inner part and the center gear is integral with the drive shaft, and that the gear train comprises a single idler gear whose axis of rotation is parallel to the axis of the drive shaft and whose teeth have a crest which on either side arcuately slopes downwardly in the direction of the axis of rotation and the internal ring gear is set into the outer part and is held to the internal surface of the outer part through clamping means.

The simple expedient of making the drive shaft of the roll in accordance with the invention integral with the center gear and supporting it by its inner end on the inner part results in a number of advantages. For one thing, with this design the gear train need only have one idler gear, with the result that the journal or the inner part, respectively, is weakened at only one point, namely, the point where this one idler gear projects. Because of this, and because the coupling which in the prior-art arrangement must be provided in the journal is eliminated, both the journal and the center gear may be of relatively small size. Center gear and shaft can then be fabricated from one piece, which results in a considerable saving in material and simplification of construction. The transmission ratio between center gear and internal ring gear can be relatively high, with the result that only low torques need to be transmitted through the drive shaft since high rotative input speeds, and hence low-priced high-speed motors, can be employed. Deflections of the outer part are compensated through the special arcuate shape of the tooth crests on the idler gear. Finally, the special way in which the internal ring gear is secured to the outer part of the roll assures positive and troublefree transmission of torques.

It has been found that the roll in accordance with the invention permits substantial savings in motive power through simple, low-cost mechanical means and is extremely quiet in operation even at high speeds of rotation.

In a particularly advantageous embodiment of the roll of the invention, the clamping means used are two nested clamping rings which bear on each other by their conical, slotted surfaces, are disposed between the internal ring gear and the internal surface of the outer part, and by their inner end faces abut on a stop that is attached to the outer part, while their outer end faces are subject to the action of an adjusting ring which by means of set screws can be moved in the longitudinal direction of the outer part. In this way, optimal adjustable transmission of torques from the internal ring gear to the outer part of the roll is made possible.

It is advantageous, moreover, that the thickness of the ring gear be greater than that of the idler gear. This provides assurance that no transmission problems will arise even with pronounced deflections of the outer part of the roll with respect to the center axis of the drive shaft.

In a further advantageous embodiment, drive shaft, center gear, idler gear and internal ring gear are accommodated in an interior space which with respect to the passage of a liquid is continuous, is outwardly sealed, and is connected to at least one lubricant feed pipe and a lubricant drain pipe. The drive members are thus arranged in a space-saving manner in an interior space of relatively small volume which is tightly sealed against the surrounding space and is connected to a lubricant circulation system. This results in considerable advantages, especially in view of the high speeds of rotation required for machine speeds of about 400 meters per minute and up.

DESCRIPTION OF A SPECIFIC EMBODIMENT

Figure 1:
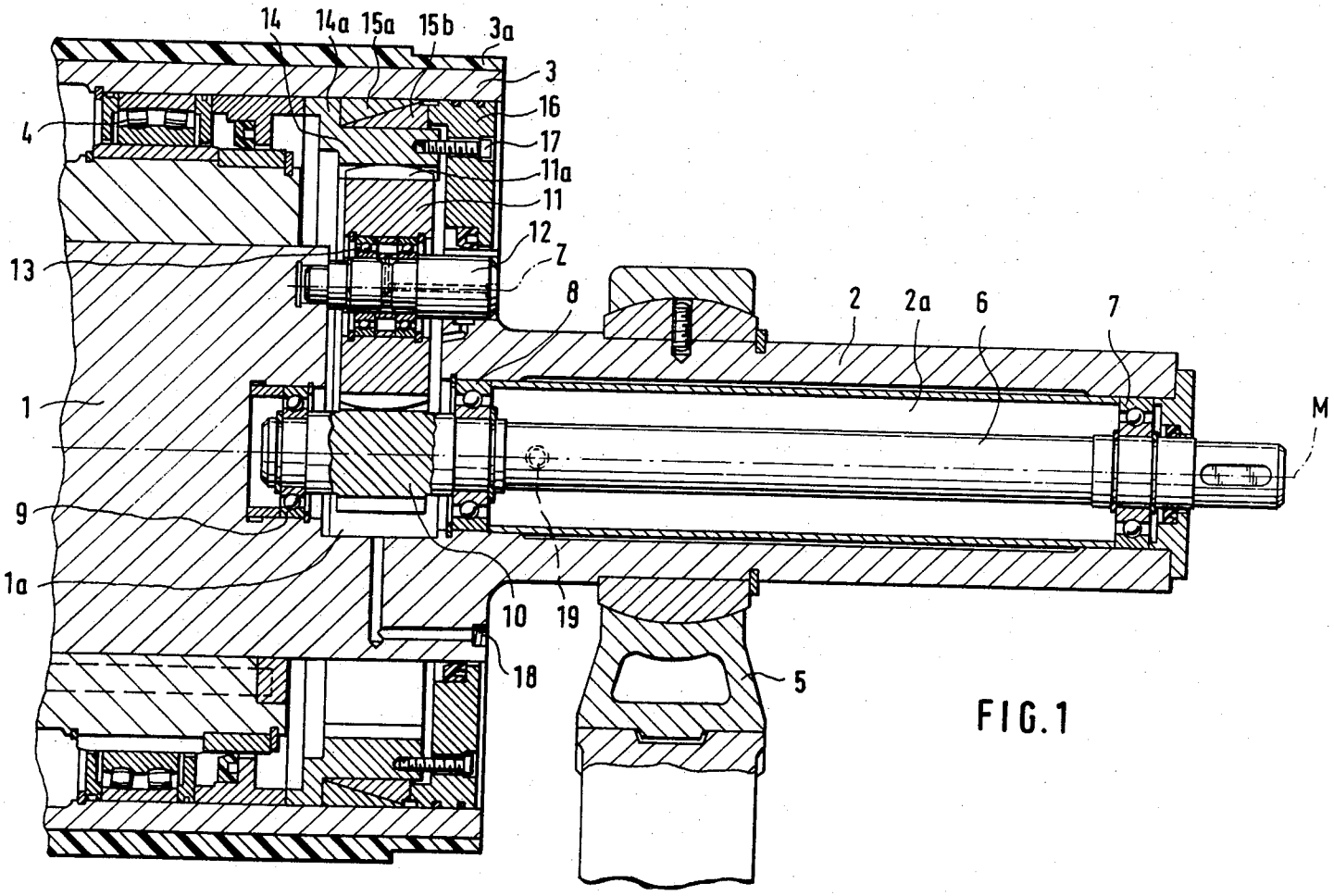
Figure 2:
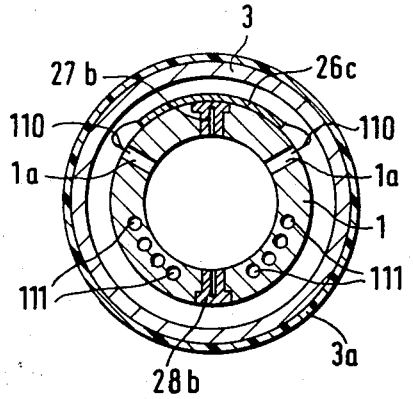

An embodiment of the roll in accordance with the invention will now be described in greater detail with reference to the accompanying drawings:

FIG. 1 shows one end of a roll of controllable flexure in longitudinal section, and FIG. 2 is a cross section through the roll according to FIG. 1

The drawing shows one end of a roll of controllable flexure in longitudinal section. The roll comprises a substantially cylindrical inner part 1 which terminates at both ends in a journal 2. The journal 2 shown is hollow and has a continuous inner space 2*a* which ends in a recess 1*a* in the inner part 1. The journal 2 is supported on a massive bearing 5.

Supported on the inner part 1 through roller bearings 4 is a tubular outer part 3 on whose external surface a separate roller shell 3*a* is disposed.

The roller bearing 4 is a self-aligning roller bearing. Additional self-aligning roller bearings (not shown) are disposed along the length of the roll. Moreover, there are provided on the inner part 1 along a generatrix, in a manner which is not shown, means for the generation of compulsive forces acting radially between the inner part and the outer part whereby controllable flexure is secured. These means may be constructed as described in U.S. Pat. No. 4,233,011.

To permit the outer part 3 to be driven, there extends through the interior 2*a* of the journal 2 a drive shaft 6 which at its outer end is supported on the journal 2 through a ball bearing 7 and at its other end is supported on the inner part 1 through further ball bearings 8 and 9. Disposed between the ball bearings 8 and 9 is a center gear 10 which is of relatively small diameter and is integral with the drive shaft 6. The center gear 10 meshes with an idler gear 11 which is supported through a ball bearing 13 on a shaft 12 mounted above the center gear 10 on the inner part 1. The idler gear 11 in turn meshes with an internal ring gear 14 which is set into the outer part 3 and through two clamping rings 15*a* and 15*b* is secured to the internal surface of the outer part 3. As is readily apparent from the drawing, the clamping ring 15*a* abuts by the end face which is directed toward the interior of the roll on a stop 14*a* that is a part of the internal ring gear 14. By a conical surface, the clamping ring 15*a* abuts on a likewise conical surface of the other clamping ring 15*b*, whose outer end face is in contact with an adjusting ring 16 externally set onto and secured to the internal ring gear 14 through set screws 17. The adjusting ring 16 is displaceable in the longitudinal direction of the outer part by means of said set screws 17. Through displacement of the adjusting ring 16, the two wedgelike clamping rings 15*a* and 15*b* can be shifted relative to each other, and in this way the contact pressure between the internal ring gear 14 and the outer part 3 can be varied. The two clamping rings 15*a* and 15*b* are appropriately slotted, in a manner which is not shown, to prevent jamming.

As is further apparent from the drawing, the teeth 11*a* of the idler gear 11, whose axis of rotation Z is parallel to the axis of rotation M of the drive shaft 6, have a crest which is arcuately curved in the direction of the axis of rotation Z, that is to say, the height of the crest of the teeth decreases on either side of the center plane of the idler gear 11. When the internal ring gear 14 is skewed due to a more or less pronounced deflection of the roll, the mating surfaces of the internal ring gear 14 and of the idler gear 11 are thus able to remain in rolling contact with each other so that they continue to be in mesh and there is no break in transmission.

The gear ratio between the center gear 10 and the internal ring gear 14 may be relatively high, for example, 1:5. The outer end of the drive shaft 6 can then be connected to a relatively high-speed electric motor.

It should be noted that the transmission of torque between the internal ring gear 14 and the outer part 1 is effected strictly by operative engagement and not through bolted joints. Thus no problems will arise at this point from non-uniform loading of the joint, for example, due to tolerances of bolts and bolt holes.

Because of the small volume of the interior spaces 2*a* and 1*a* in which the moving parts 6 to 14 are disposed, it is possible to connect the combined interior space 1*a* and 2*a* to a lubricant circulation system. Lubricant is supplied through a feed pipe 19 and further feed pipes which are not shown, and is drained through a pipe 18.

On the side which in FIG. 2 is the upper side of the inner part 1, there are disposed in the longitudinal direction between the roller bearings 4 electric heating strips 26*c*. These heating strips extend over an angle of about 90 degrees in the circumferential direction of the inner part. Moreover, in the lower half of the inner part 1 there are disposed cooling ducts 111 through which a coolant can be conducted. In the inner part 1, bores are provided on the internal side adjacent to the heating strips 26*c* in which temperature sensors 27*b* are disposed, and in the lower half of the inner part 1, bores are provided on the internal side in which temperature sensors 28*b* are disposed. The temperature sensors 27*b* and 28*b* permit the temperature difference between the upper side and the lower side of the inner part to be determined.

"The heating strips 26*c* are heated by means of electric feed lines 110 until a specific temperature difference between the heated upper side of the inner part 1 and the cooled lower side of the inner part 1 is reached. Because of the unilateral heating of the inner part 1, the latter will arch upwardly on the heated side, and this arching will be transmitted through the roller bearings 4 to the outer part 3. Thus a controllable flexure of the roll is achieved."

It will be appreciated that the instant specification and claims are set forth by way of illustration and not of limitation, and that various changes and modifications may be made without departing from the spirit and scope of the present invention.

What is claimed is:

1. In a drivable roll of controllable flexure, particularly for machines for the production and processing of webs of paper or plastic, which comprises a substantially cylindrical inner part which through journals is firmly supported on a bearing surface, and a tubular outer part which surrounds the inner part and is supported at both ends on the inner part for rotation about the cylinder axis, there being disposed on the inner part along a generatrix means for the generation of compulsive forces acting radially between the inner part and the outer part, a drive shaft which extends coaxially through one of the journals and in proximity to its outer end is supported on the journal being connected to a center gear which through a gear train mounted on the inner part drives an internal ring gear that is coaxial with the outer part and is in a driving relation therewith, the improvement wherein said drive shaft is supported at its inner end on said inner part and said center gear is integral with said drive shaft and said gear train comprises a single idler gear whose axis of rotation is parallel to the axis of said drive shaft, and whose teeth have a crest which arcuately slopes downwardly on either side in the direction of the axis of rotation, said internal ring gear being set into the outer part and secured through clamping means to the internal surface of said outer part.

2. A roll according to claim 1, wherein said clamping means comprise two nested clamping rings which bear on each other by their conical, slotted surfaces, said clamping means being disposed between said internal ring gear and the internal surface of the outer part, and by the inner end faces of said nested clamping rings abut on a stop that is attached to said outer part, while the outer end faces of said nested clamping rings bear against and are subject to the action of an adjusting ring which is set into said outer part and by means of at least one set screw is moveable in the longitudinal direction of said outer part.

3. A roll according to claim 1 wherein the thickness of said ring gear is greater than that of said idler gear.

4. A roll according to claim 1, wherein said drive shaft, said center gear, said idler gear and said internal ring gear are accommodated within and interior space which with respect to the passage of a liquid is continuous, is outwardly sealed, and is connected to at least one lubricant feed pipe and a lubricant drain pipe.

* * * * *